US009198827B1

(12) United States Patent
Robinson

(10) Patent No.: US 9,198,827 B1
(45) Date of Patent: Dec. 1, 2015

(54) TUB MOUNTED FOOT MASSAGE SYSTEM

(71) Applicant: Mercella Robinson, Loganville, GA (US)

(72) Inventor: Mercella Robinson, Loganville, GA (US)

( * ) Notice: Subject to any disclaimer, the term of this patent is extended or adjusted under 35 U.S.C. 154(b) by 165 days.

(21) Appl. No.: 14/165,634

(22) Filed: Jan. 28, 2014

(51) Int. Cl.
*A47K 3/022* (2006.01)
*A61H 33/00* (2006.01)
*A61H 35/00* (2006.01)

(52) U.S. Cl.
CPC ..... *A61H 33/0087* (2013.01); *A47K 3/022* (2013.01); *A61H 35/006* (2013.01)

(58) Field of Classification Search
CPC ..... A61H 35/006
USPC ..... 4/619–660
See application file for complete search history.

(56) References Cited

U.S. PATENT DOCUMENTS 501,304 A 7/1893 Stephenson
771,124 A 9/1904 Caldwell
3,374,492 A * 3/1968 Ruderian ..... A61H 33/0087 4/541.4
3,924,278 A * 12/1975 Ekman ..... A47K 3/007 4/540
4,443,900 A * 4/1984 Remeyer ..... A61H 33/0087 4/488
4,857,112 A * 8/1989 Franninge ..... A61H 33/0087 134/22.1
5,010,605 A * 4/1991 Shiina ..... A61H 33/0087 4/488
5,333,322 A * 8/1994 Weir ..... E04H 4/14 4/496
5,987,663 A * 11/1999 Ludlow ..... A61H 33/027 4/541.1
6,503,212 B2 * 1/2003 Park ..... A61H 7/007 601/101
7,013,503 B2 * 3/2006 Walker ..... A61H 7/001 4/541.1
8,296,874 B2 10/2012 Galati, Jr. et al.
2003/0226201 A1 * 12/2003 Leung ..... A47K 3/022 4/622
2005/0172392 A1 * 8/2005 Swart ..... A61H 33/026 4/541.5
2011/0023225 A1 * 2/2011 Kaykov ..... A61H 33/0087 4/541.1

FOREIGN PATENT DOCUMENTS

WO WO2004024052 3/2004
WO WO2004060123 7/2004

* cited by examiner

*Primary Examiner* — Lori Baker
(74) *Attorney, Agent, or Firm* — Kyle A. Fletcher, Esq.

(57) ABSTRACT

The water massage assembly for massaging a user's feet in a tub includes a tub that may contain a fluid. A user is positioned in the fluid. A pump is coupled to the tub. A control is operationally coupled to the pump. The control controls an operational parameter of the pump. A first jet is coupled to the tub. The first jet is operationally coupled to the pump. The pump urges air outwardly from the first jet onto the user's body. A foot box is operationally coupled to the tub. The foot box may receive the user's feet. A second jet is coupled to the foot box. The second jet is operationally coupled to the pump. The pump urges air outwardly from the second jet onto the user's feet.

18 Claims, 2 Drawing Sheets

TUB MOUNTED FOOT MASSAGE SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of massage systems, more specifically, tub mounted foot massage systems.

SUMMARY OF THE INVENTION

An embodiment of the disclosure meets the needs presented above by generally comprising a tub that may contain a fluid. A user is positioned in the fluid. A pump is coupled to the tub. A control is operationally coupled to the pump. The control controls an operational parameter of the pump. A first jet is coupled to the tub. The first jet is operationally coupled to the pump. The pump urges air outwardly from the first jet onto the user's body. A foot box is operationally coupled to the tub. The foot box may receive the user's feet. A second jet is coupled to the foot box. The second jet is operationally coupled to the pump. The pump urges air outwardly from the second jet onto the user's feet.

An object of the invention is to provide a device that is tub mounted as well as a foot massage system.

These together with additional objects, features and advantages of the tub mounted foot massage system will be readily apparent to those of ordinary skill in the art upon reading the following detailed description of presently preferred, but nonetheless illustrative, embodiments of the tub mounted foot massage system when taken in conjunction with the accompanying drawings.

In this respect, before explaining the current embodiments of the tub mounted foot massage system in detail, it is to be understood that the tub mounted foot massage system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the tub mounted foot massage system.

It is therefore important that the claims be regarded as including such equivalent construction insofar as they do not depart from the spirit and scope of the tub mounted foot massage system. It is also to be understood that the phraseology and terminology employed herein are for purposes of description and should not be regarded as limiting.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
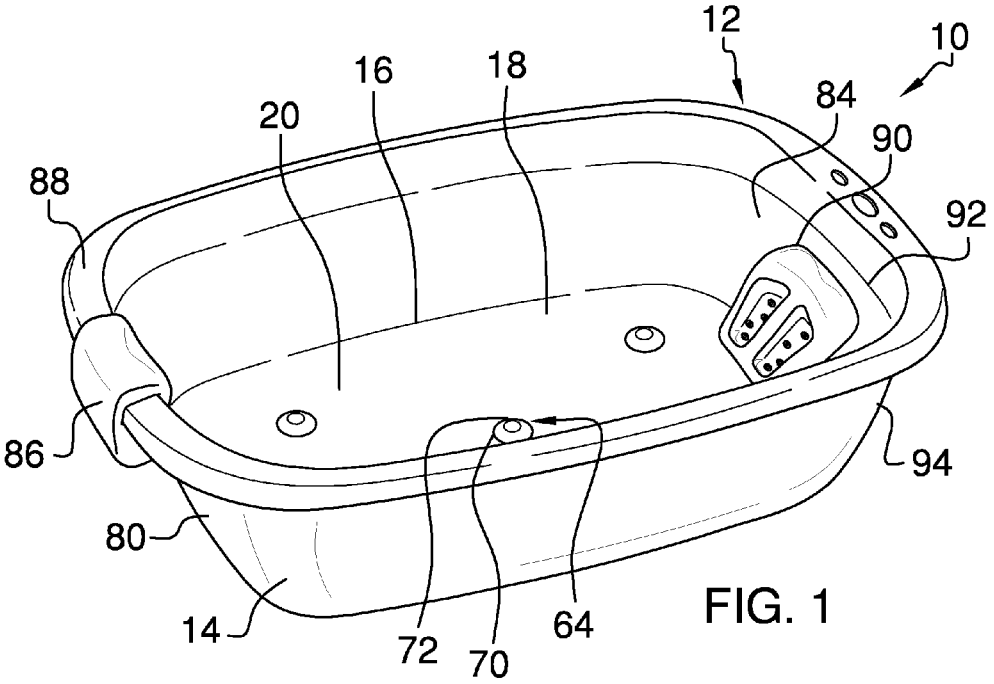
FIG. 1 is a top perspective view of a water massage assembly according to an embodiment of the disclosure.
Figure 2:
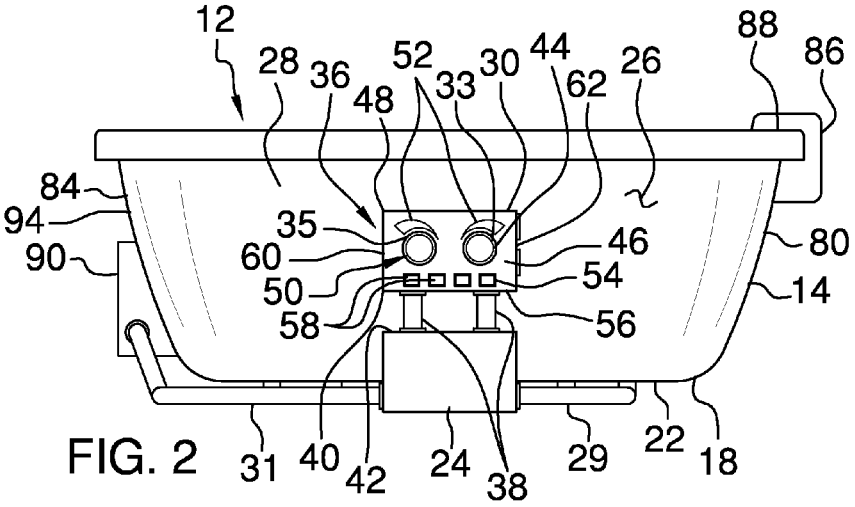
FIG. 2 is a left side view of an embodiment of the disclosure.
Figure 3:
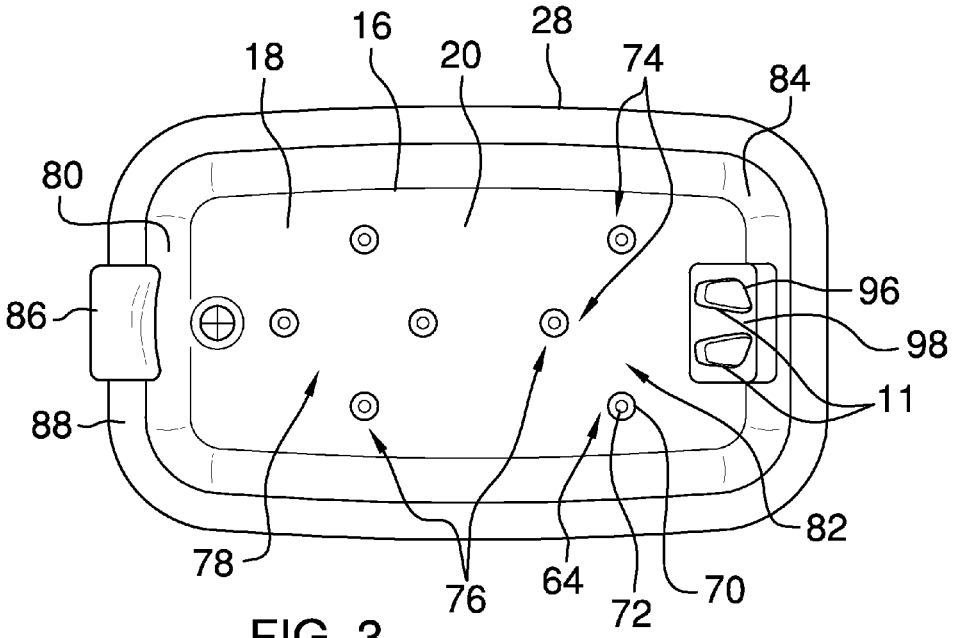
FIG. 3 is a top view of an embodiment of the disclosure.
Figure 4:
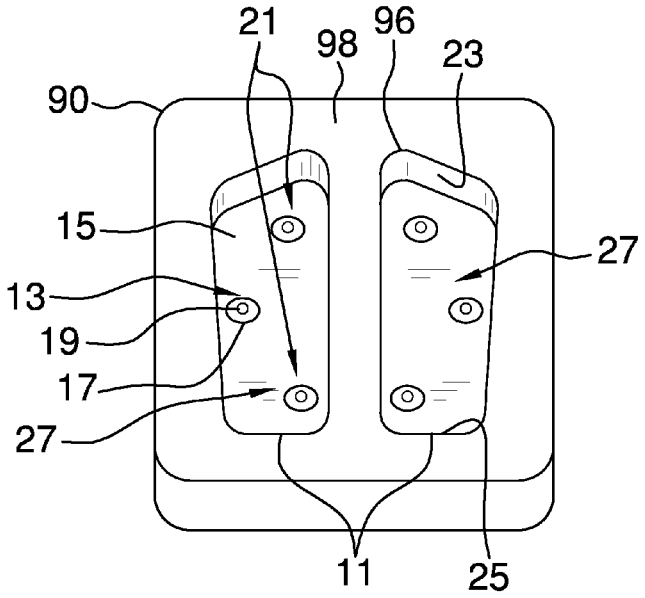
FIG. 4 is a front view of an embodiment of the disclosure.

As best illustrated in FIGS. 1 through 4, the water massage assembly 10 generally comprises a tub 12. An outer wall 14 of the tub 12 extends upwardly from an outer edge 16 of a bottom wall 18 of the tub 12. The tub 12 has an ovoid cross section taken along a longitudinal axis extending through a top side 20 and a bottom side 22 of the bottom wall 18 of the tub 12. Moreover, the tub 12 may contain a fluid so a user is positionable in the fluid. The fluid may be water. Lastly, the tub 12 may be a bath tub of any conventional design.

A pump 24 is coupled to an outer surface 26 of a second lateral side 28 of the outer wall 14 of the tub 12 proximate the bottom wall 18 of the tub 12. The pump 24 may be an air pump of any conventional design. A control 30 is coupled to the outer surface 26 of the second lateral side 28 of the outer wall 14 of the tub 12 proximate a middle 36 of the outer wall 14 of the tub 12. A pair of control pipes 38 is fluidly coupled between a bottom 40 of the control 30 and a top 42 of the pump 24. The control 30 controls an operational parameter of the pump 24.

An actuator 44 is coupled to a front side 46 of an outer wall 48 of the control 30. The actuator 44 is operationally coupled to the pump 24 wherein the actuator 44 selects an output pressure of the pump 24. Moreover, the actuator 44 comprises a dial 50 rotatably coupled to the front side 46 of the outer wall 48 of the control 30. The actuator 44 is one of a pair of the actuators 52.

A secondary actuator 54 is coupled to the front side 46 of the outer wall 48 of the control 30. The secondary actuator 54 is positioned proximate a bottom side 56 of the outer wall 48 of the control 30. Continuing, the secondary actuator 54 is operationally coupled to the pump 24. The secondary actuator 54 is one of a plurality of secondary actuators 58. Lastly, the plurality of secondary actuators 58 is evenly distributed between a first lateral side 60 and a second lateral side 62 of the outer wall 48 of the control 30.

A first jet 64 extends upwardly through the bottom side 22 and the top side 20 of the bottom wall 18 of the tub 12. A ring 70 is coupled to an open top end 72 of the first jet 64. The ring 70 abuts the top side 68 of the bottom wall 18 of the tub 12. Lastly, the first jet 64 is one of a plurality of the first jets 74.

The plurality of first jets 74 comprises a pair of sets of the plurality of first jets 76. A first one of the pair of sets of first jets 78 is arranged in a diamond shape proximate a back side 80 of the outer wall 14 of the tub 12. Continuing, a second one of the pair of sets of first jets 82 is arranged in a diamond shape proximate a front side 84 of the outer wall 14 of the tub 12. A pillow 86 is coupled to a top edge 88 of the back side 80 of the outer wall 14 of the tub 12. The user places the user's head against the pillow 86.

A foot box 90 extends through a front side 92 and a back side 94 of the front side 84 of the outer wall 14 of the tub 12 proximate the bottom wall 18 of the tub 12. Additionally, a foot well 96 extends forwardly into a front side 98 of the foot box 90. The foot well 96 is shaped like a human foot. Moreover, the foot well 96 is one of a pair of spaced foot wells 11. Each of the pair of spaced foot wells 11 insertably receives an associated one of the user's feet.

A second jet 13 extends through a back wall 15 of the foot well 96. A ring 17 is coupled to an open top end 19 of the second jet 13. The ring 17 abuts the back wall 15 of the foot well 96. The second jet 13 is one of a plurality of the second jets 21.

The plurality of second jets 21 is staggered between a top end 23 and a bottom end 25 of the foot well 96. Moreover, the plurality of second jets 21 comprises a pair of sets of the plurality of second jets 27. Each of the pair of sets of second jets 27 is positioned in an associated one of the pair of the spaced foot wells 11. The pair of sets of second jets 27 directs air onto each of the user's feet.

A first pipe 29 is fluidly coupled between the pump 24 and each of the second set of first jets 82. The first pipe 29 delivers air to each of the second set of first jets 82. A second pipe 31 is fluidly coupled between the pump 24 and each of the first set of first jets 78 and the plurality of second jets 21. The second pipe 31 delivers air to each of the plurality of second jets 21 and the first set of first jets 78.

In use, the tub 12 is filled with the fluid. The user manipulates a first one of the pair of actuators 33 to adjust a pressure of the second set of first jets 82. Continuing, the user manipulates a second one of the pair of actuators 35 to adjust a pressure of the first set of first jets 78 and the plurality of second jets 21. Each of the first 33 and second 35 actuators may be adjusted at any time while the assembly 10 is utilized. The user sits in the tub 12 so the first 78 and second 82 sets of jets massages the users body and the plurality of second jets 21 massages the user's feet.

With respect to the above description, it is to be realized that the optimum dimensional relationship for the various components of the water massage assembly 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the water massage assembly 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A water massage assembly for massaging a user's feet in a tub, said assembly comprising:
- a tub configured to contain a fluid wherein the user is positioned in the fluid;
- a pump coupled to said tub;
- a control operationally coupled to said pump wherein said control controls an operational parameter of said pump;
- a first jet coupled to said tub, said first jet being operationally coupled to said pump wherein said pump urges air outwardly from said first jet onto the user's body;
- a foot box operationally coupled to said tub wherein said foot box is configured to receive the user's feet; and
- a second jet coupled to said foot box, said second jet being operationally coupled to said pump wherein said pump urges air outwardly from said second jet onto the user's feet;
- wherein a foot well extending forwardly into a front side of said foot box.

2. The assembly according to claim 1 wherein an outer wall of said tub extending upwardly from an outer edge of a bottom wall of said tub wherein said tub has an ovoid cross section taken along a longitudinal axis extending through a top side and a bottom side of said bottom wall of said tub.

3. The assembly according to claim 1 wherein said pump being coupled to an outer surface of a second lateral side of an outer wall of said tub proximate a bottom wall of said tub.

4. The assembly according to claim 1 wherein said control being coupled to an outer surface of a second lateral side of an outer wall of said tub proximate a middle of said outer wall of said tub.

5. The assembly according to claim 1 wherein:
- an actuator coupled to a front side of an outer wall of said control;
- said actuator being operationally coupled to said pump wherein said actuator selects an output pressure of said pump; and
- said actuator being one of a pair of said actuators.

6. The assembly according to claim 1 wherein said first jet extending upwardly through a bottom side and a top side of a bottom wall of said tub.

7. The assembly according to claim 6 wherein:
- said first jet being one of a plurality of said first jets;
- said plurality of first jets comprising a pair of sets of said plurality of first jets;
- a first one of said pair of sets of first jets being arranged in a diamond shape proximate a back side of an outer wall of said tub; and
- a second one of said pair of sets of first jets being arranged in a diamond shape proximate a front side of said outer wall of said tub.

8. The assembly according to claim 1 wherein said foot box extending through a front side and a back side of a front side of an outer wall of said tub proximate a bottom wall of said tub.

9. The assembly according to claim 1 wherein said foot well being one of a pair of spaced foot wells wherein each of said pair of spaced foot wells insertably receives an associated one of the user's feet.

10. The assembly according to claim 1 wherein said second jet extending through a back wall of a foot well.

11. The assembly according to claim 10 wherein said second jet being one of a plurality of said second jets.

12. The assembly according to claim 11 wherein said plurality of second jets being staggered between a top end and a bottom end of said foot well.

13. The assembly according to claim 12 wherein:

said plurality of second jets comprising a pair of sets of said plurality of second jets; and each of said pair of sets of second jets being positioned in an associated one of a pair of foot wells.

14. The assembly according to claim 1 wherein:

a first pipe fluidly coupled between said pump and each of a plurality of first jets wherein air is delivered to each of said plurality of first jets; and a second pipe fluidly coupled between said pump and each of a plurality of second jets wherein air is delivered to each of said plurality of second jets.

15. A water massage assembly for massaging a user's feet in a tub, said assembly comprising:

a tub configured to contain a fluid wherein the user is positioned in the fluid;

a pump coupled to said tub;

a control operationally coupled to said pump wherein said control controls an operational parameter of said pump;

a first jet coupled to said tub, said first jet being operationally coupled to said pump wherein said pump urges air outwardly from said first jet onto the user's body;

a foot box operationally coupled to said tub wherein said foot box is configured to receive the user's feet;

a second jet coupled to said foot box, said second jet being operationally coupled to said pump wherein said pump urges air outwardly from said second jet onto the user's feet;

wherein said foot box extending through a front side and a back side of a front side of an outer wall of said tub proximate a bottom wall of said tub; a foot well extending forwardly into a front side of said foot box; said foot well being one of a pair of spaced foot wells wherein each of said pair of spaced foot wells insertably receives an associated one of the user's feet.

16. The assembly according to claim 15 wherein an outer wall of said tub extending upwardly from an outer edge of a bottom wall of said tub wherein said tub has an ovoid cross section taken along a longitudinal axis extending through a top side and a bottom side of said bottom wall of said tub; said pump being coupled to an outer surface of a second lateral side of said outer wall of said tub proximate said bottom wall of said tub; said control being coupled to an outer surface of a second lateral side of said outer wall of said tub proximate a middle of said outer wall of said tub; an actuator coupled to a front side of an outer wall of said control; said actuator being operationally coupled to said pump wherein said actuator selects an output pressure of said pump; said actuator being one of a pair of said actuators.

17. The assembly according to claim 15 wherein said first jet extending upwardly through a bottom side and a top side of a bottom wall of said tub; said first jet being one of a plurality of said first jets; said plurality of first jets comprising a pair of sets of said plurality of first jets; a first one of said pair of sets of first jets being arranged in a diamond shape proximate a back side of an outer wall of said tub; a second one of said pair of sets of first jets being arranged in a diamond shape proximate a front side of said outer wall of said tub.

18. The assembly according to claim 15 wherein said second jet extending through a back wall of a foot well; said second jet being one of a plurality of said second jets; said plurality of second jets being staggered between a top end and a bottom end of said foot well; said plurality of second jets comprising a pair of sets of said plurality of second jets; each of said pair of sets of second jets being positioned in an associated one of a pair of said foot wells; a first pipe fluidly coupled between said pump and each of a plurality of said first jets wherein air is delivered to each of said plurality of first jets; a second pipe fluidly coupled between said pump and each of said plurality of second jets wherein air is delivered to each of said plurality of second jets.

* * * * *